US005078381A

United States Patent [19]

Brabant et al.

[11] Patent Number: 5,078,381

[45] Date of Patent: Jan. 7, 1992

[54] PAPER FEED APPARATUS FOR FOLDER

[76] Inventors: Yvan E. Brabant, 9125 Old Pine Rd., Boca Raton, Fla. 33428; Alfred Milo, 7100 Woodlake Dr., Palm Bay, Fla. 32905

[21] Appl. No.: 506,466

[22] Filed: Apr. 9, 1990

[51] Int. Cl.[5] ..... B65H 3/10

[52] U.S. Cl. ..... 271/99; 271/124; 271/171

[58] Field of Search ..... 271/94–96, 271/99, 121, 124, 171

[56] References Cited

U.S. PATENT DOCUMENTS 3,291,482 12/1966 Stemmler ..... 271/99 X
4,106,762 8/1978 Faltin ..... 271/99 X
4,168,829 9/1979 Wilson ..... 271/99 X

*Primary Examiner*—Richard A. Schacher
*Attorney, Agent, or Firm*—James B. Middleton

[57] ABSTRACT

The feed table of a paper folder is provided with a downward step at the discharge end of the feed table. The downward step provides a discharge area so that the leading edge of a sheet can be pulled forward and down for a positive feed without wrinkling the leading edge through contact with the feed table. A vacuum wheel engages and holds the paper to effect the feed, and the vacuum wheel has an increased number of holes for a stronger grip. The rear ends of paper guides are movable by screws for carefully controlled skewing of the paper with respect to the feed table.

13 Claims, 3 Drawing Sheets

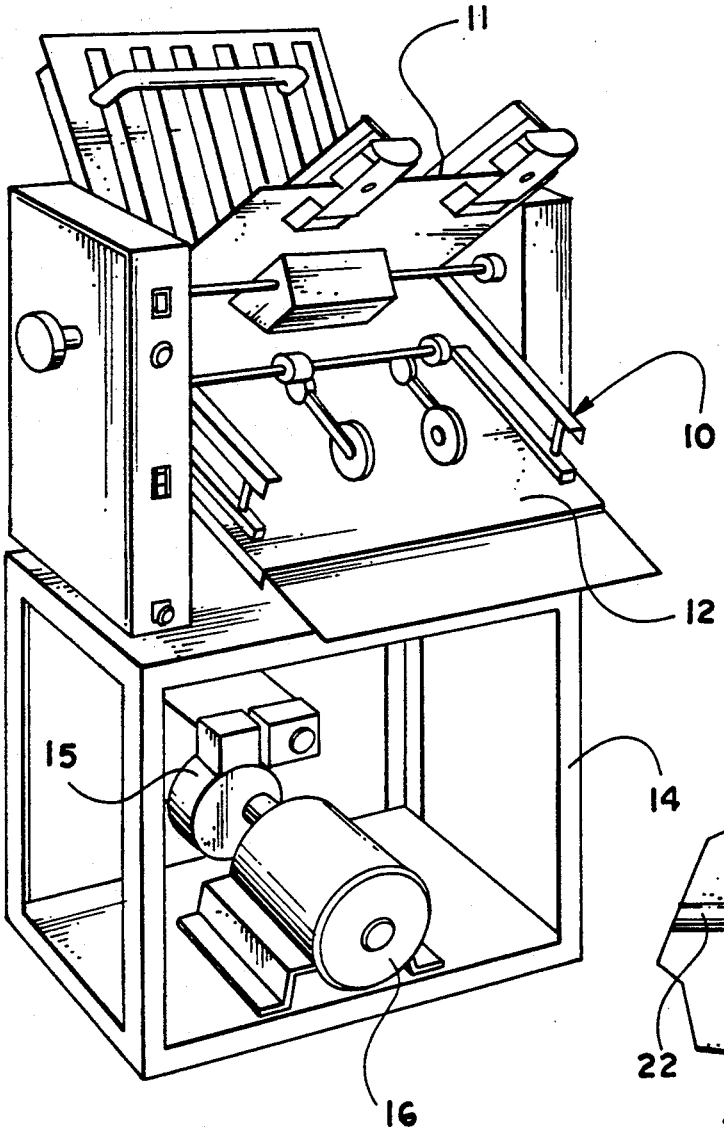
Fig. 1
Fig. 3
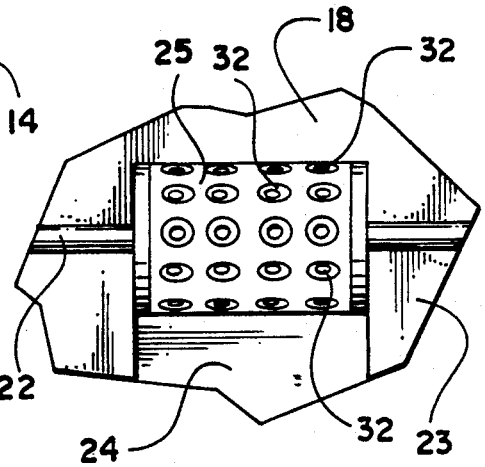
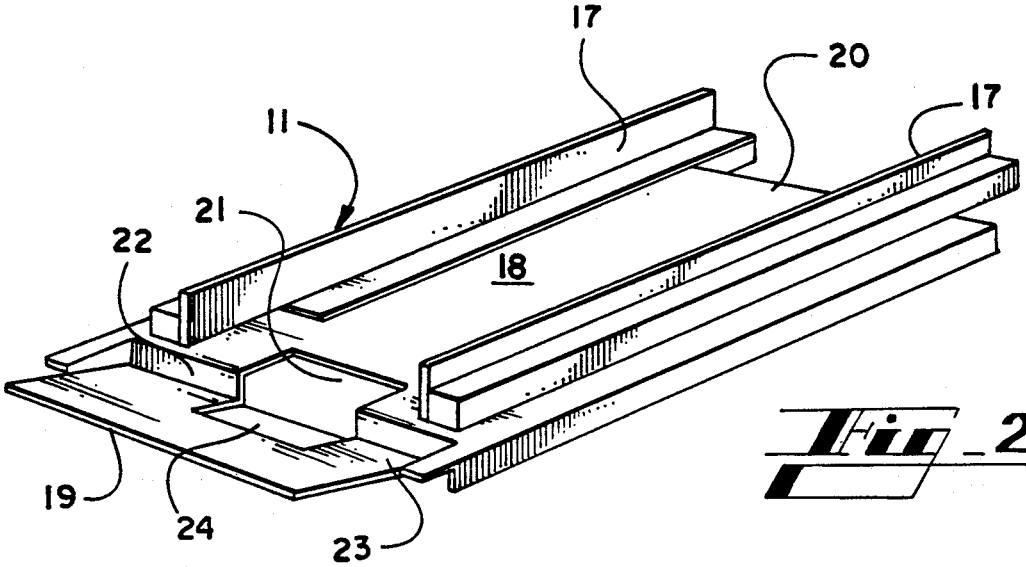
Fig. 2

Fig. 4
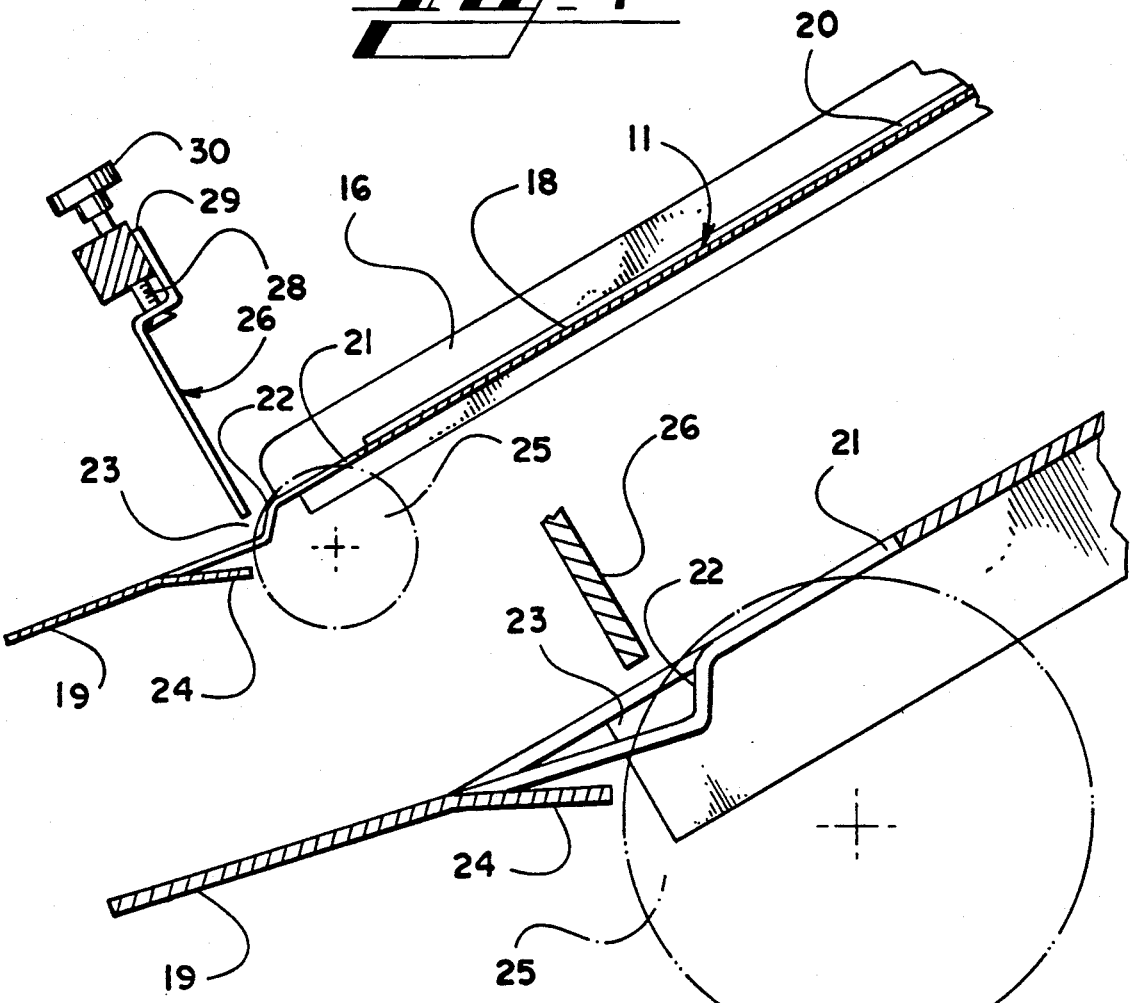
Fig. 5
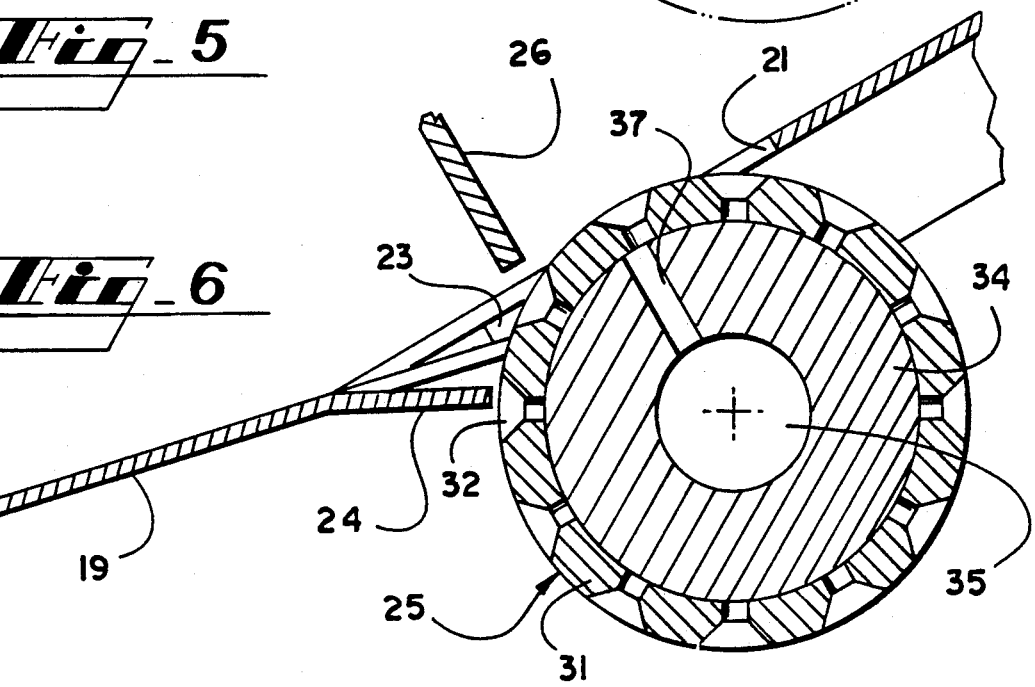
Fig. 6

PAPER FEED APPARATUS FOR FOLDER

INFORMATION DISCLOSURE STATEMENT

Automatic paper folders are well known in the art, and such apparatus has been highly developed into commercially successful machines. While these machines operate well enough to be commercially successful, there are some deficiencies in need of improvement.

The typical paper folder has a feed tray that includes a paper gauge. The paper gauge holds the leading edge of the stack of paper to be folded, and allows sheets to be moved successively beneath the gauge and into the folding mechanism. The individual sheets are pulled from the stack and caused to pass beneath the paper gauge by means of a vacuum wheel. The idea is that the vacuum wheel pulls a single sheet from the bottom of the stack to be folded, passes the sheet beneath the paper gauge and into the folding mechanism. It is of course important to adjust the paper gauge so that only a single sheet passes beneath the gauge. In order to prevent the feeding of multiple sheets, the conventional paper folder requires considerable experience in setting the paper gauge. While logic would dictate that the gauge should be set in accordance with the thickness of the paper, practice does not give the same result. If the gap between the paper gauge and the feed table is too small, even one sheet does not feed accurately, but impinges on the paper gauge and causes a jam. In an effort to prevent the jams, the paper gauge may be raised from the feed table, and two or more sheets may feed simultaneously. Only through long experience can a person determine how to set the paper gauge for a given thickness of paper. With an experienced operator, a sheet is fed beneath the paper gauge, and the gauge is adjusted until the operator can feel a certain drag on the paper. This particular drag on the paper cannot be precisely defined, but must be determined through long experience.

Even with a highly skilled operator, the paper gauge on a conventional folder must be adjusted for each different type of paper. The different thicknesses of paper require different settings, so the paper gauge must be constantly readjusted as the folder is used for different stocks. Further, with all these adjustments, the paper folder will not operate without jams at its rated capacity.

It will also be understood that, to be folded accurately, the leading edge of the paper must be precisely perpendicular to the direction of feed. If the paper is not cut accurately, the feed must be skewed somewhat, and this skewing is accomplished by changing the paper guides on the feed table. To do this, the guides are loosened, adjusted, and retightened. When the guides are loosened, all reference points are lost, so a person cannot be sure what degree of adjustment is being made.

SUMMARY OF THE INVENTION

This invention relates generally to sheet feeding apparatus, and is more particularly concerned with paper feed means for a folder.

The present invention provides a feed table on a conventional paper folder, the feed table including a vacuum wheel for engaging the bottom sheet in a stack of paper to be fed. The feed table defines an opening through which the vacuum wheel protrudes; and, the feed table has a downward step at the vacuum wheel, then rises to the desired discharge level. The vacuum wheel preferably includes a relatively large number of openings to apply suction to the bottom sheet of paper for a secure grip on the sheet. The downward step in the feed table, then, allows the vacuum wheel to pull the sheet forwardly to position the sheet below the paper gauge and into a discharge area. This additional movement is allowed without having the sheet contact the feed tray, so the sheet feed is smooth and uninterrupted.

In using the apparatus of the present invention, it has been found that one setting of the paper gauge can be maintained through a wide variety of paper thicknesses, and the paper feed rate can be up to or beyond rated speed without causing paper jams or mis-feeds.

To align the paper properly, the paper guides on the feed table can be skewed under the influence of screw adjustment. The arrangement allows the paper guides to remain in place when the guides are skewed, the position changing slightly, and positively, by rotation of a screw. Small changes in the paper guides can therefore be effected without trial and error settings. BRIEF DESCRIPTION OF THE DRAWINGS These and other features and advantages of the present invention will become apparent from consideration of the following specification when taken in conjunction with the accompanying drawings in which:

FIG. 1 is a perspective view of a conventional paper folder to which the present invention is applied;

FIG. 2 is a perspective view of the feed table for the folder of FIG. 1 made in accordance with the present invention;

FIG. 3 is a fragmentary plan view showing the vacuum wheel protruding through the feed table of FIG. 2;

FIG. 4 is a transverse cross-sectional view taken through the feed table of the present invention, and showing the paper gauge in conjunction therewith, the vacuum wheel being shown in phantom;

FIG. 5 is an enlarged detail view showing the area of the feed table having the vacuum wheel protruding therethrough, the vacuum wheel being shown in phantom;

FIG. 6 is a view similar to FIG. 5 but showing the vacuum wheel in full lines;

DETAILED DESCRIPTION OF THE EMBODIMENT

Figure 7:
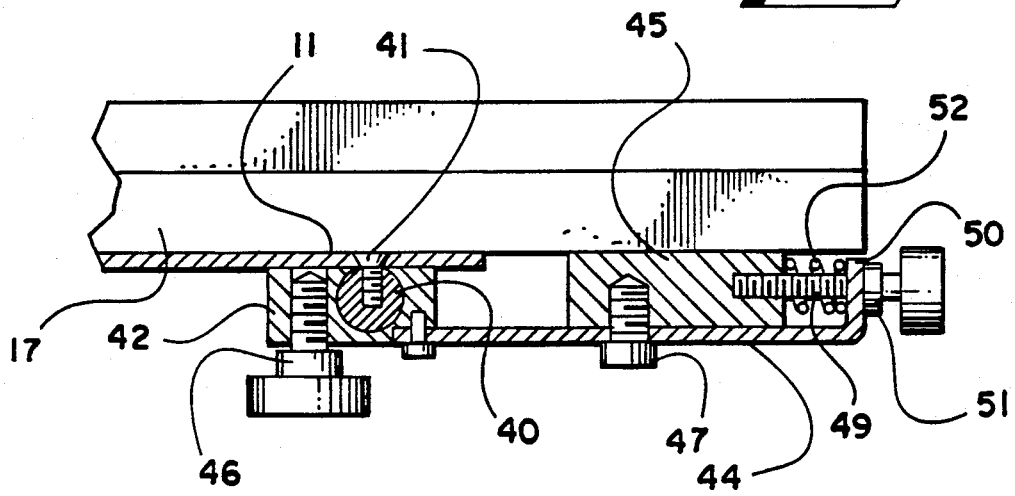
FIG. 7 is an enlarged, cross-sectional view illustrating the paper guide skewing structure; and, FIG. 8 is an enlarged, top plan view of the structure shown in FIG. 7, the paper guide being shown in phantom.

Referring now more particularly to the drawings, and to that embodiment of the invention here presented by way of illustration, FIG. 1 shows a conventional folder generally designated at 10, and including a paper feed table 11 and a delivery tray 12. The folder 10 is carried by a table 14, and there is a vacuum pump 15 on the lower shelf of the table 14. A motor 16 drives the vacuum pump 15. Since the folding apparatus 10 is well known in the art, no further description of the overall device is thought to be necessary.

Attention is now directed to FIG. 2 of the drawings which illustrates the feed table 11 made in accordance with the present invention. It will be seen that the feed table 11 includes a generally planar paper carrying surface 18 having a discharge end 19, which will also be referred to as the front, or forward, end. The table 11 also includes a rear end 20. The paper guides 17 will be discussed in more detail later.

The forward portion of the feed table 11 defines an opening 21 to receive the vacuum wheel, but the vacuum wheel is not shown in FIG. 2. It will be seen in FIG. 2, however, that the area of the feed table 11 that includes the opening 21 has a downward step indicated at 22. The paper carrying surface 18 is substantially uniform until the step 22; then, the feed table 11 is offset downwardly, then slopes upwardly to the forward end 19. Within the opening 21, a tongue 24 extends towards the vacuum wheel for substantially closing the gap. The area at the downward step, and forward thereof, is the discharge area 23.

Looking at FIG. 3 of the drawings, the vacuum wheel is indicated at 25 and is shown in conjunction with the feed table 11. It will be seen that the tongue 24 extends substantially to the vacuum wheel 25, and the vacuum wheel 25 otherwise substantially fills the opening 21.

Attention is next directed to FIG. 4 of the drawings. The feed table 11 is shown in the appropriate orientation for use in the folder illustrated in FIG. 1, and the paper gauge 26 is illustrated in its proper relationship to the feed table 11.

First, it will be understood that the paper gauge 26 is perpendicular to the feed table 11, and is carried by a screw 28, the screw 28 being threadedly engaged with a hole through the member 29. The member 29 is stationary with respect to the frame of the folder 10; therefore, when the screw 28 is rotated by means of the knob 30, the paper gauge 26 will be moved towards or away from the feed table 11, depending on the direction of rotation of the knob.

In FIG. 4 of the drawings, it will be seen that the feed table 11 will receive a stack of paper, the forward edges of the sheets of paper being against the paper gauge 26. As a single sheet is fed from the bottom of the stack, the sheet will be engaged by the vacuum wheel 25 and pulled well forwardly, down and under the paper gauge 26. At this point it will be understood that, if the feed table 11 were flat as is conventional in the art, the leading edge of the paper could not be pulled very far, or it would engage the feed table and wrinkle, thereby causing feeding problems. Since the feed table 11 of the present invention includes the downward step at 22, there is considerable additional space in the discharge area 23, for feeding of the sheet of paper before the sheet engages the feed table 11. As a result, the sheet of paper can be fed forwardly to a sufficient extent for the leading edge of the sheet to be past the paper gauge 26.

A further understanding will be had with attention to FIG. 5 of the drawings. In FIG. 5 the scale is large enough to see that the paper will be resting on the surface 18, the forward edge of the stack of paper being stopped by the paper gauge 26. The vacuum wheel 25 is shown in phantom, and it will be noticed that the stack of paper on the surface 18 will be supported at its leading edge by the apex of the vacuum wheel 25. When the vacuum is supplied through the wheel 25, and the wheel 25 rotates, it will be noticed that the bottom sheet in the stack will be moved in the arcuate path, or pulled down and forward simultaneously, so the bottom sheet will be pulled beneath the paper gauge 26. Since the bottom sheet is held by a vacuum, it will be understood that the next sheet will tend to remain straight and to remain abutted against the paper gauge 26. As a result, it is very unlikely that two sheets will be fed by the vacuum wheel 25. Additionally, because of the step 22 in the support table 11 defining the discharge area 23, the bottom sheet can be fed forward to a considerable extent without engaging a surface to cause feed problems.

Looking next at FIG. 6 of the drawings, the vacuum wheel 25 is shown in full lines, and it will be seen that the vacuum wheel 25 includes a rotatable outer ring 31 having a plurality of openings 32 therethrough. There is a stationary core 34 which includes a vacuum manifold 35 having a plurality of radial openings 37 communicating therewith. As the individual opening 32 are successively aligned with the radial openings 37, the vacuum will be applied through the openings 32 to attract a sheet of paper thereagainst. As the opening 32 leaves the opening 37, the paper will be released. This general arrangement is well known in the art and no further description is thought to be necessary for a full understanding.

It will therefore be understood that the present invention provides a feeding arrangement that allows the vacuum wheel to engage the paper quite firmly, and to pull the lowermost sheet from the stack of paper downwardly and forwardly. Because of the design of the feed table, the paper can be pulled sufficiently forward to be well past the tip of the paper gauge 26. This arrangement allows paper from about a 16 pound bond paper up to about a 70 pound coated paper to be fed without any adjustment to the setting of the paper gauge 26. The paper gauge 26 can be set with a gap of about 0.035–0.040 inch between the lowermost end of the paper gauge 26 and the surface of the vacuum wheel 25. It is important to note, as is shown in FIG. 3 of the drawings, that the vacuum wheel 25 includes four rows of holes 32 as opposed to the usual two rows of holes. While the use of four rows is not required, it will be understood by those skilled in the art that some increased hold on the paper is necessary to allow the high pile of paper, and in order to obtain the definite and precise feeding of the paper under and beyond the paper gauge 26 at the high rates of speed obtainable in using the present invention.

To feed paper successfully, it is important that the leading edge of the paper be oriented perpendicularly to the direction of feed. While this ought to be rather automatic, paper is not always cut accurately. The solution in the folder is therefore to angle, or skew, the paper guides 17 to orient the leading ed of the paper properly.

Looking at FIG. 7 of the drawings, it will be understood that the paper guides 17 are movable laterally to accommodate different widths of paper. FIG. 7 shows the rear end of the feed table 11 with the means for holding and adjusting the rear end of the paper guide 17. It will be seen that there is a laterally extending shaft 40 fixed to the table 11 by screws 41. A slide block 42 is slidable along the shaft 40. A plate 44 is fixed to the slide block 42 for movement therewith. A skew block 45 is then carried by the plate 44, and the paper guide 17 is fixed to the skew block 45. As a result, when the slide block 42 is moved along the shaft 40, the entire assembly, including the paper guide 17, will be moved laterally. This movement can be prevented by tightening the screw 46 which locks the block 42 to the feed table 11.

Figure 8:
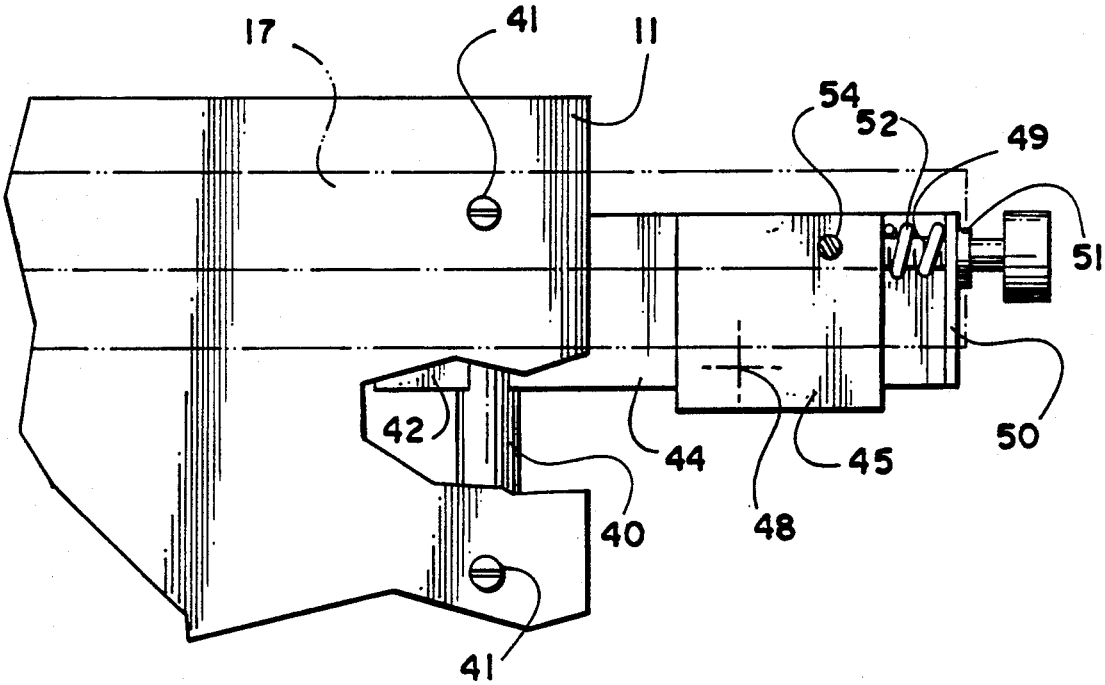

Looking now at FIGS. 7 and 8, it will be noticed that the skew block 45 is pivotally fixed to the plate 44 by a screw 47. In FIG. 8, the screw 47 is hidden, but intersecting centerlines show the pivot point which is indicated at 48. With the skew block held at the one point 48, a skew adjusting screw 49 can precisely rotate the block 45. The screw 49 passes through the flange 50 of the plate 44, and is held from inward movement by a collar 51. The screw 49, then, threadedly engages the block 45 so that rotation of the screw 49 causes motion of the block in the counterclockwise direction as viewed in FIG. 8.

The paper guide 17 is fixed to the skew block 45 at 54. Thus, as the screw 49 is rotated, the skew block 45 will be rotated about the pivot 48, causing the paper guide 17 to move. The forward end of the paper guide 17 will be generally fixed in position, so motion of the rear end of the guide 17 will cause angular movement of the paper guide 17. It is of course contemplated that the screw 49 will have relatively fine threads so slight motion is possible, with adequate locking of the position desired.

As an example of the improvements wrought by the present invention, a conventional folder having a gear speed capability to fold 30,000 sheets per hour would actually fold only 18,000 to 20,000 per hour. With the improvements of the present invention, a full ream of paper can be placed on the feed table, and the apparatus will feed up to 30,000 sheets per hour. By changing the motor pulleys to increase the folder rpm, the device is able to feed 36,000 sheets per hour. Further, by replacing the air pump with a larger pump, the machine can feed at the rate of 41,000 sheets per hour. The enhanced vacuum prevents slip, and the improved feed table prevents jams due to paper wrinkling.

It will therefore be understood by those skilled in the art that the apparatus of the present invention resolves the usual difficulties with the feeding mechanism on paper folders and allows the accurate feeding of one sheet at a time at a high rate of speed. The step in the feed table allows the bottom sheet to be fed forwardly sufficiently to be well forward of the gauge 26 before being released by the vacuum wheel. Since the vacuum wheel positively holds the paper and pulls the bottom sheet down and forwardly, the paper gauge can be set and not changed through a wide variety of paper stocks.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

We claim:

1. A feed table for a paper folder, said table including a generally planar paper supporting surface, a forward end of said table and a rearward end thereof, said table defining an opening therethrough adjacent to said forward end for receiving a vacuum wheel, said table defining a downward step at said opening for defining a discharge area below said paper supporting surface and forward of the apex of said vacuum wheel, the arrangement being such that a sheet of paper is pulled off said paper supporting surface by said vacuum wheel, and the leading edge of said sheet of paper is received within said discharge area for preventing wrinkling of said sheet.

2. A feed table as claimed in claim 1, said feed table sloping upwardly in the area of said discharge area to said forward end of said table.

3. A feed table as claimed in claim 2, and further including a tongue in said opening, said tongue extending from the forward end of said opening towards said vacuum wheel and the rearward end of said opening.

4. A feed table for a paper folder, said table including a generally planar paper supporting surface, a forward end of said table and a rearward end thereof, said table defining an opening therethrough adjacent to said forward end for receiving a vacuum wheel, said table defining a downward step at said opening for defining a discharge area of said feed table below said paper supporting surface, said feed table including a pair of paper guides extending longitudinally of said feed table, each paper guide of said pair of paper guides including a skew block pivotally carried at the rear end of said feed table, said skew block including a pivot point about which said skew block is pivoted, said paper guide being pivotally fixed to said skew block, said paper guide defining a pivot point laterally displaced from said pivot point for said skew block, and means for causing rotation of said skew block about said pivot point for said skew block.

5. A feed table as claimed in claim 4, and further including a plate extending rearwardly from said feed table, said skew block being carried by said plate, and a flange on said plate, a screw extending through said flange for threadedly engaging said skew block, said screw constituting said means for causing rotation of said skew block.

6. In a paper folder comprising a feed table having a generally planar surface for supporting a stack of paper to be fed therefrom, said feed table having a forward end from which sheets from said stack of paper are fed, and a rearward end, a vacuum wheel adjacent to said forward end for engaging and moving said sheets from said stack of paper, said vacuum wheel defining at least two rows of holes therein for applying vacuum to said sheets, said table defining an opening therethrough for receiving said vacuum wheel, and a paper gauge extending generally perpendicularly with respect to said feed table for holding the forward edge of said stack of paper, the improvement wherein said feed table defines a downward step at said opening for defining a discharge area below said paper supporting surface and forward of the apex of said vacuum wheel, the arrangement being such that a sheet of paper is pulled off said paper supporting surface by said vacuum wheel, and the leading edge of said sheet of paper is pulled beneath said paper gauge and is received within said discharge area for preventing wrinkling of said sheet.

7. The improvement as claimed in claim 6, wherein said vacuum wheel includes an apex extending above said planar surface of said feed table for receiving said stack of paper and engaging the bottom sheet in said stack of paper.

8. The improvement as claimed in claim 7, said paper gauge being located just forward of said downward step, the lower end of said paper gauge being spaced below said apex of said vacuum wheel, the arrangement being such that said vacuum wheel grips the bottom sheet of paper in said stack of paper and moves said bottom sheet forwardly and downwardly while said paper gauge stops other sheets in said stack of paper.

9. The improvement as claimed in claim 8, wherein said vacuum wheel defines at least three rows of holes therein for increasing the grip of said vacuum wheel on said bottom sheet of paper.

10. The improvement as claimed in claim 9, wherein said feed table slopes upwardly in the area of said discharge area to said forward end.

11. The improvement as claimed in claim 10, said paper gauge being located just forward of said apex of said vacuum wheel.

12. In a paper folder comprising a feed table having a generally planar surface for supporting a stack of paper to be fed therefrom, said feed table having a forward end from which sheets from said stack of paper are fed, and a rearward end, a vacuum wheel adjacent to said forward end for engaging and moving said sheets from said stack of paper, said vacuum wheel defining at least two rows of holes therein for applying vacuum to said sheets, said table defining an opening therethrough for receiving said vacuum wheel, and a paper gauge extending generally perpendicularly with respect to said feed table for holding the forward edge of said stack of paper, the improvement wherein said feed table defines a downward step at said opening for defining a discharge area of said feed table below said paper supporting surface, and the further improvement wherein said feed table includes a pair of paper guides extending longitudinally of said feed table, each paper guide of said pair of paper guides including a skew block pivotally carried at the rear end of said feed table, said skew block including a pivot point about which said skew block is pivoted, said paper guide being fixed to said skew block, said paper guide defining a pivot point laterally displaced from said pivot point for said skew block, and means for causing rotation of said skew block about said pivot point for said skew block.

13. In a paper folder as claimed in claim 12, the improvement including a plate extending rearwardly from said feed table, said skew block being carried by said plate, and a flange on said plate, a screw extending through said flange for threadedly engaging said skew block, said screw constituting said means for causing rotation of said skew block.

* * * * *